US008573734B2

(12) United States Patent
Singh

(10) Patent No.: US 8,573,734 B2
(45) Date of Patent: Nov. 5, 2013

(54) MOVABLE SPITTOON PLATFORM

(75) Inventor: Kundan Singh, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 40 days.

(21) Appl. No.: 13/197,935

(22) Filed: Aug. 4, 2011

(65) Prior Publication Data

US 2013/0033541 A1 Feb. 7, 2013

(51) Int. Cl.
*B41J 2/165* (2006.01)

(52) U.S. Cl.
USPC ..... 347/32

(58) Field of Classification Search
None
See application file for complete search history.

(56) References Cited

U.S. PATENT DOCUMENTS 5,980,018 A * 11/1999 Taylor et al. ..... 347/31
5,984,450 A 11/1999 Becker et al.
6,168,258 B1 1/2001 Lou et al.
6,247,783 B1 6/2001 Shibata et al.
6,250,736 B1 6/2001 Wojcik
6,357,853 B1 3/2002 Askren et al.
6,409,303 B1 6/2002 Anderson et al.
6,644,776 B1 * 11/2003 Barinaga et al. ..... 347/33
7,175,251 B2 2/2007 Gaston et al.
7,731,329 B2 6/2010 Yearout et al.
2002/0101462 A1 8/2002 Therien
2003/0035018 A1 * 2/2003 Therien ..... 347/22
2010/0118082 A1 * 5/2010 Tojo ..... 347/30

* cited by examiner

*Primary Examiner* — Matthew Luu
*Assistant Examiner* — Alejandro Valencia

(57) ABSTRACT

Embodiments of the present disclosure include systems and methods of handling ink using a movable spittoon platform. A frame defines at least a reservoir portion and a side wall protrusion adjacent the reservoir portion. A shuttle includes a platform slidably movable between a first position, in which the platform is biased to extend outwardly from an end portion of the shuttle, and a second position, in which the platform becomes retracted relative to the end portion of the shuttle. The shuttle is slidably movable relative to the frame toward the spittoon portion wherein, upon releasable contact of the platform against the protrusion, the platform moves from the first portion into the second portion to scrape ink off the platform into the reservoir portion below the shuttle.

21 Claims, 9 Drawing Sheets

MOVABLE SPITTOON PLATFORM

BACKGROUND

Many conventional printers use a printhead to deposit small droplets of ink in a desired pattern onto a media, such as paper. Proper operation of a printhead involves periodic servicing, such as spitting, wiping, priming, etc. In some conventional printers, a printhead assembly travels to a stationary service station at which the servicing operations are performed. Conventional service stations typically include a stationary spittoon into which ink is spit from the printhead. Despite the wide variety of spittoons that are deployed in a conventional service station, some printers' still experience dysfunction associated with ink waste. In one example, the spittoon does not sufficiently contain the accumulating ink waste such that the ink waste migrates or spreads into areas of the printer beyond the service station and interferes with the normal functions of the printer.

DETAILED DESCRIPTION

Figure 1:
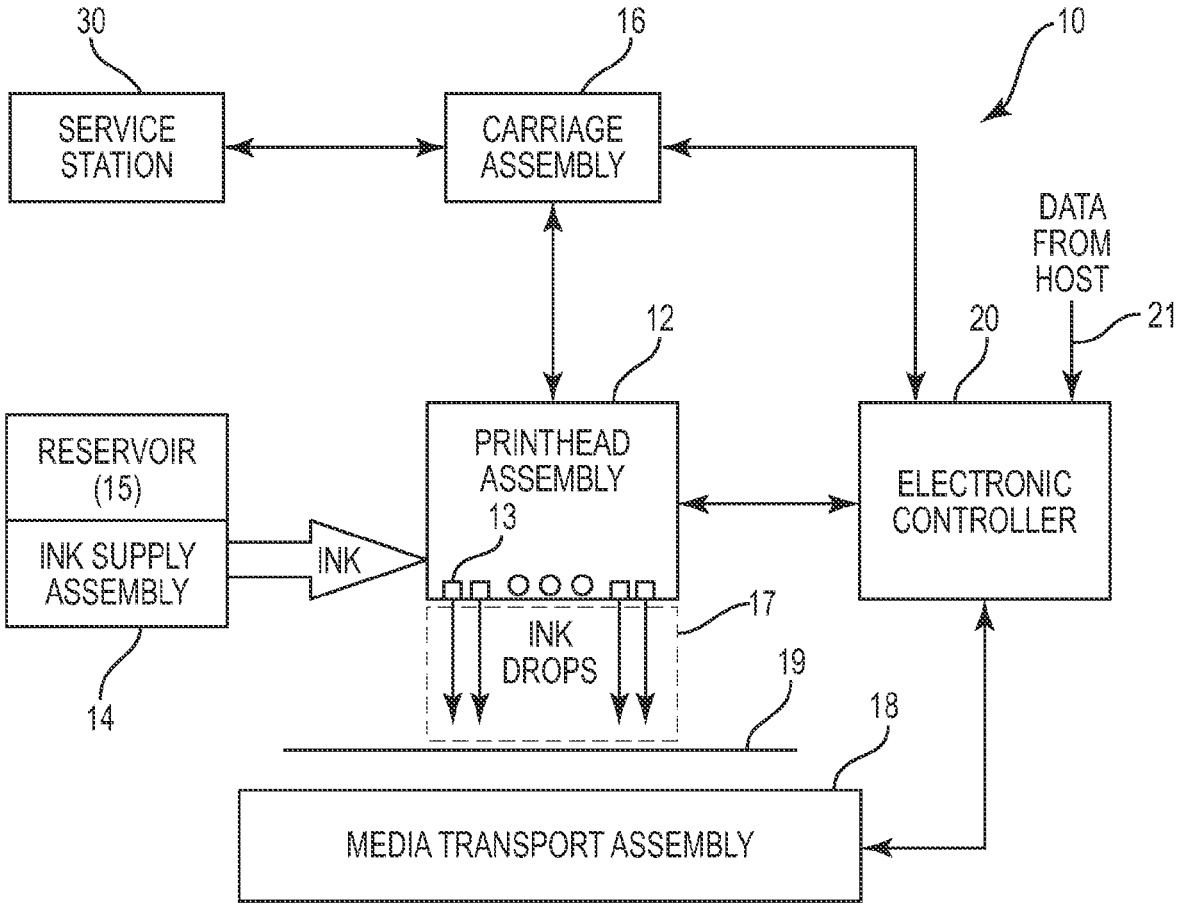
FIG. 1 is a block diagram of a printer, according to an embodiment of the present disclosure.

In the following detailed description, reference is made to the accompanying drawings which form a part hereof, and in which is shown by way of illustration specific embodiments of the present disclosure that may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Embodiments of the present disclosure are directed a movable spittoon platform. In one embodiment, the spittoon platform is movable between a first exposed position, for receiving ink spit from a printhead, and a second retracted position. The spittoon platform is biased in the first position and then automatically moved into the second position. In particular, as the spittoon platform is moved into the second position, any ink waste accumulated on the spittoon platform is scraped off via a stationary element positioned over the spittoon platform.

In some embodiments, the spittoon platform is mounted on an end portion of a shuttle that is slidably movable relative to a stationary spittoon frame. In one aspect, the shuttle moves along a length of the spittoon frame during a servicing operation of a printhead, such as wiping the printhead and/or scraping the wipers. By this movement of the shuttle, the spittoon platform is moved toward an end portion of the spittoon frame at which the spittoon platform releasably contacts a first stationary element of the spittoon frame, which in turn, automatically causes the spittoon platform to slidably retract from its first extended position. During this automatic slidable retraction, the ink waste is scraped off the spittoon platform in a manner further described below.

In one embodiment, the shuttle includes a second stationary element located vertically above the spittoon platform and positioned to cause sliding contact of a top surface of the spittoon platform relative to a bottom portion of this second stationary element as the spittoon platform moves into its second retracted position. During this sliding contact, the second stationary element scrapes ink waste off the spittoon platform and into a reservoir portion of the spittoon frame located vertically below the spittoon platform. In one embodiment, the reservoir portion is located at an end portion of the spittoon frame and the ink waste is scraped off the spittoon platform as the shuttle moves into its second position adjacent the end portion of the spittoon frame.

In this way, ink waste is not permitted to accumulate beyond capacity in the area at which spitting (or priming) occurs because the ink waste is transported away from the spitting location to a reservoir location remote from the spitting location. Moreover, because the reservoir portion is located remotely from the spitting location, the reservoir portion is made relatively larger than otherwise possible and therefore the overall capacity of the service station for storing ink waste is increased. Finally, the scraping action is automatically initiated generally simultaneously with a movement of the shuttle for wiping printheads (or scraping wipers) so that a single movement of the shuttle accomplishes multiple servicing actions of wiping printheads, scraping wipers, and removing ink waste from a spitting location to a remote reservoir portion. For at least these reasons, embodiments of the present disclosure efficiently and effectively prevent unwanted migration of ink waste from the spitting location to other areas of the service station and the printer in general.

These embodiments, and other embodiments, are further described and illustrated in association with FIGS. 1-12.

FIG. 1 illustrates a printer 10 in accordance with one embodiment of the present disclosure. Printer 10 includes a printhead assembly 12, an ink supply assembly 14, a carriage assembly 16, a media transport assembly 18, an electronic controller 20, and a service station 30. Printhead assembly 12 includes one or more printheads which eject drops of ink through orifices or nozzles 13 and toward a print media 19 so as to print onto print media 19. In one embodiment, printhead assembly 12 includes inkjet printheads, such as thermal inkjet printheads while in other embodiments, printhead assembly 12 includes other types of printhead, such as but not limited to, piezoelectric printheads. Print media 19 is any type of suitable sheet material, such as paper, card stock, plastics, and the like.

Typically, nozzles 13 of printhead assembly 12 are arranged in one or more columns or arrays such that a properly sequenced ejection of ink from nozzles 13 causes characters, symbols, and/or other graphics or images to be printed upon print media 19 as printhead assembly 12 and print media 19 are moved relative to each other.

Ink supply assembly 14 supplies ink to printhead assembly 12 and includes a reservoir 15 for storing ink. As such, ink flows from reservoir 15 to printhead assembly 12. In one embodiment, printhead assembly 12 and ink supply assembly 14 are housed together in an inkjet cartridge or pen. In some embodiments, ink supply assembly 14 is separate from printhead assembly 12 but still directly communicates ink to the printhead assembly 12 via a releasable connection with the ink supply assembly 14. This embodiment is sometimes referred to as an on-axis configuration of the ink supply assembly 14. However, in other embodiments, the ink supply assembly 14 is positioned remotely from the printhead assembly 12, with the ink supply assembly 14 communicating ink to the printhead assembly 12 via an array of supply tubes. This embodiment is sometimes referred to as an off-axis configuration of the ink supply assembly 14.

Carriage assembly 16 positions printhead assembly 12 relative to media transport assembly 18 and media transport assembly 18 positions print media 19 relative to printhead assembly 12. Thus, a print zone 17 is defined adjacent to nozzles 13 in an area between printhead assembly 12 and print media 19. In one embodiment, printhead assembly 12 is a non-scanning type printhead assembly. As such, carriage assembly 16 fixes printhead assembly 12 at a prescribed position relative to media transport assembly 18. Thus, media transport assembly 18 advances or positions print media 19 relative to printhead assembly 12. In another embodiment, printhead assembly 12 is a scanning type printhead assembly in which carriage assembly 16 moves printhead assembly 12 relative to media 19 on the media transport assembly 18.

Electronic controller 20 communicates with printhead assembly 12, media transport assembly 18, carriage assembly 16, and service station 30. Electronic controller 20 receives data 21 from a host system, such as a computer, and includes memory for temporarily storing data 21. Typically, data 21 is sent to printing system 10 along an electronic, infrared, optical or other information transfer path. Data 21 represents, for example, an image, a document, and/or file to be printed. As such, data 21 forms a print job for printing system 10 and includes one or more print job commands and/or command parameters.

In general terms, controller 20 provides signals to direct the actions and movements of the various components, modules, elements, and assemblies of printer 10 during printing operations and servicing operations. In one embodiment, controller 20 includes central processing units, application specific integrated circuits ASICs, microcontrollers, and/or other processing elements.

In one aspect, controller 20 includes a memory storing software including instructions for performing the printing and servicing operations described herein. Examples of the functions performed via controller 20, include but are not limited to, initiating, monitoring, and terminating servicing operations at service station 30 and as described throughout this description in association with FIGS. 1-12.

In one embodiment, electronic controller 20 provides control of printhead assembly 12 including timing control for ejection of ink drops from nozzles 13. As such, electronic controller 20 operates on data 21 to define a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry is located remotely from printhead assembly 12.

In one embodiment, service station 30 is stationary and controller 20 causes printhead assembly 12 to move to service station 30 to receiving servicing operations. In other embodiments, service station 30 is mobile and printhead assembly 12 is stationary, and controller 20 causes service station 30 to move to printhead assembly 12 to perform servicing operations. Servicing includes, but is not limited to, spitting, priming, wiping, capping, etc.

Figure 2:
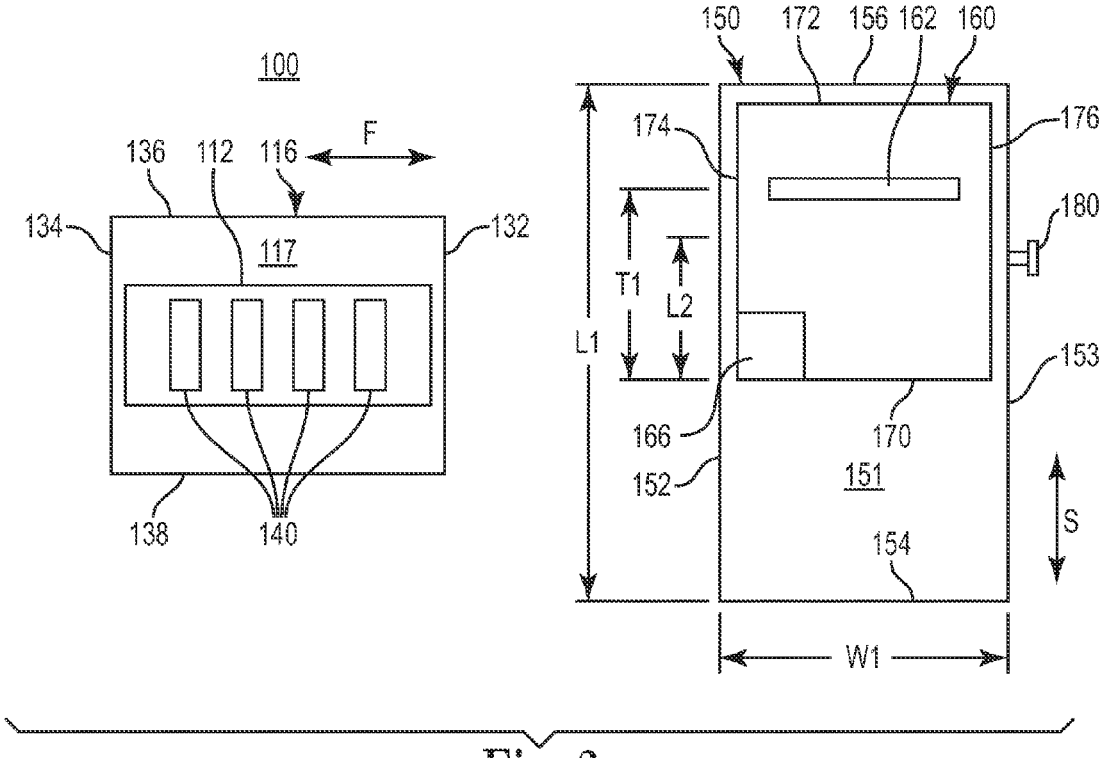
FIG. 2 is a top plan view schematically illustrating a printhead assembly in a first position relative to a service station and with a shuttle in a first position relative to a spittoon frame, according to an embodiment of the present disclosure.

FIG. 2 is a top plan view schematically illustrating a printer 100 including a printhead assembly 112 and service station 150, according to an embodiment of the present disclosure. As shown in FIG. 2, printhead assembly 112 is in a first position relative to service station 150 and shuttle 160 is in a first position relative to spittoon frame 151. In one embodiment, printer 100 includes at least substantially the same features and attributes as printer 10 previously described in association with FIG. 1, with like reference numerals referring to like elements.

As shown in FIG. 2, printhead assembly 112 is supported by carriage assembly 116. In one aspect, carriage assembly 116 includes a carriage element 117 supporting printhead assembly 112 with the carriage element 117 including a first end 132, second end 134, first side 136, and second side 138.

In another aspect, printhead assembly 112 includes an array of printheads 140. By virtue of movable carriage assembly 116, printhead assembly 112 is slidably movable in a first orientation (as represented by directional arrow F) relative to spittoon frame 151.

In one embodiment, service station 150 includes a spittoon frame 151 and a shuttle 160 slidably movable along a length (L1) of the spittoon frame 151. As shown in FIG. 2, shuttle 160 is slidably movable relative to spittoon frame 151 in a second orientation, as represented by directional arrow S. In one aspect, spittoon frame 151 includes first side 152, second side 153, first end portion 154, and second end portion 156. In another aspect, shuttle 160 includes a first end 170, second end 172, first side 174, and second side 176. As further shown in FIG. 2, in a first position of shuttle 160 relative to spittoon frame 151, second end 172 of shuttle 160 is positioned adjacent to second end portion 156 of spittoon frame 151.

In one embodiment, shuttle 160 includes at least one wiper 162 and a spittoon platform 166 adjacent first end 170 of shuttle 160. In one aspect, wiper 162 extends across a majority of a width (W1) of the shuttle 160 and is sized and positioned for wiping printheads 140 as further described in association with FIGS. 3A-5. In one embodiment, wiper 162 is closer to second end portion 172 than to first end portion 170 of shuttle 160, such that a distance (T1) between wiper 162 and first end portion 172 is greater a distance (L2) of one-half the length of shuttle 160, as shown in FIG. 2.

In one embodiment, shuttle frame 151 includes stop element 180 mounted to second side 176 of shuttle frame 151. Stop element 180 is positioned to releasably stop carriage element 117 upon contact of first end 132 of carriage element 117 against stop element 180 and thereby position printheads 140 over shuttle 160 and in the path of wiper 162. It also will be understood that in some embodiments, shuttle 160 includes and supports more than one wiper 162.

Figure 3B:
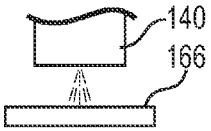
FIG. 3B is a partial side view schematically illustrating a spitting or priming operation of a printhead over a spittoon platform, according to an embodiment of the present disclosure.
Figure 3A:
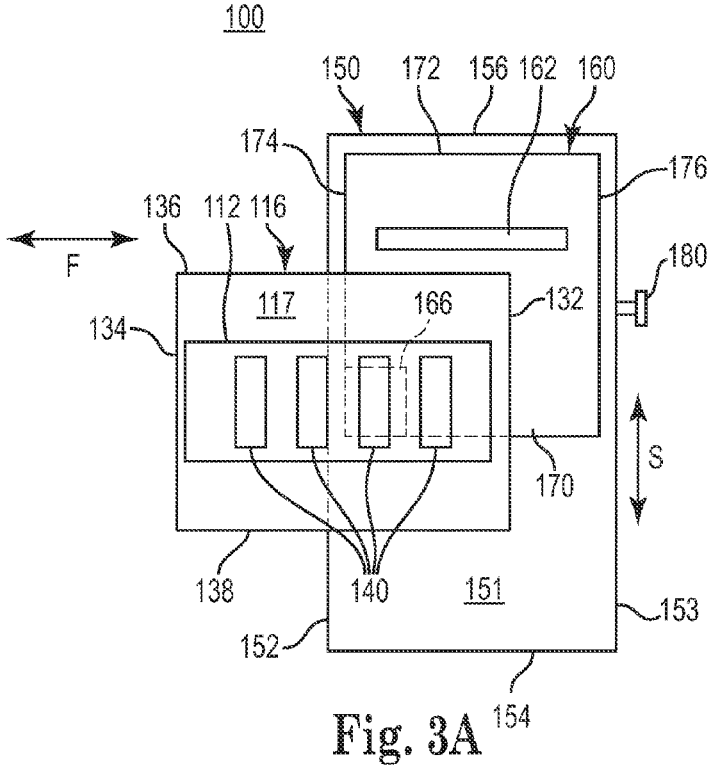
FIG. 3A is a top plan view schematically illustrating a printhead assembly in an intermediate second position relative to a service station and with a shuttle in a first position relative to a spittoon frame, according to an embodiment of the present disclosure.
Figure 4A:
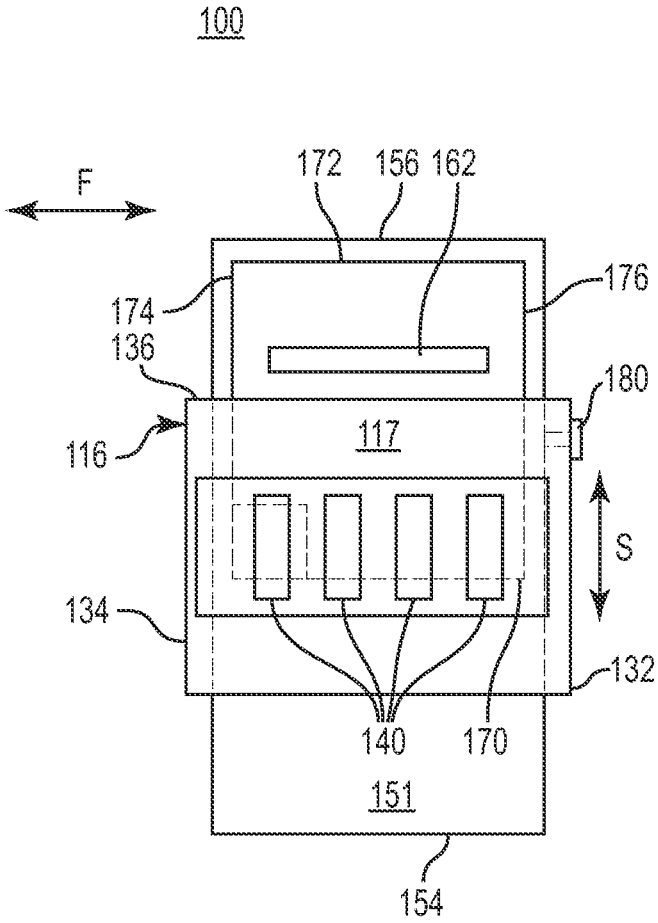
FIG. 4A is a top plan view schematically illustrating a printhead assembly in a third position relative to a service station and with a shuttle in a first position relative to a spittoon frame, according to an embodiment of the present disclosure.

FIG. 3A is a top plan view schematically illustrating printer 100, according to an embodiment of the present disclosure, with printhead assembly 112 in a second, intermediate position relative to service station 150 and with shuttle 160 remaining in a first position. As shown in FIG. 3A, printhead assembly 112 has been moved via controller 20 (FIG. 1) toward a third position in which first end 132 of carriage element 117 will releasably contact stop element 180 of spittoon frame 151, as shown in FIG. 4A. However, prior to reaching the third position (FIG. 4A), controller 20 causes the printhead assembly 112 to be moved into a position directly over spit platform 166 as shown in FIG. 3A. In one aspect, this arrangement generally corresponds to several intermediate positions of printhead assembly 112 as each printhead 140 passes over the spittoon platform 166. It also will be understood that FIG. 3A illustrates just one of these intermediate positions in which one of the printheads 140 is located over the spittoon platform 166. In some embodiments, all printheads 140 of printhead assembly 112 are arranged to be positionable simultaneously over spittoon platform 166 to simultaneously spit ink onto spittoon platform 166.

As each printhead 140 moves over spittoon platform 166, upon automatic initiation by controller 20 each printhead 140 spits ink onto spittoon platform 166 of shuttle 160, as shown in FIGS. 3A and 3B. Accordingly, this first servicing operation takes place as the printhead assembly 112 passes over the spittoon platform 166 and as the carriage element 117 approaches the stop element 180 adjacent the second side 176 of the spittoon frame 150. As ink waste is deposited by each printhead 140, ink waste begins to accumulate on spittoon platform 166 as intended.

Figure 4B:
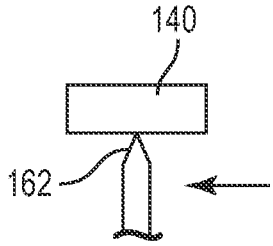
FIG. 4B is a partial side view schematically illustrating a wiper of a shuttle wiping a printhead, according to an embodiment of the present disclosure.

As shown in FIG. 4A, carriage element 117 completes travel in the first orientation (F) upon first end 132 of carriage element 117 releasably contacting stop element 180 and aligning printheads 140 in a centered position over shuttle 160. In this third position, controller 20 initiates a second servicing operation to wipe printheads 140 with wiper(s) 162. In one aspect, in this position, printheads 140 are located in a path of wiper(s) 162 so that upon movement of shuttle 160 toward first end portion 154 of shuttle frame 151, the wiper(s) 162 will perform a wiping operation on a bottom portion of each printhead, as shown in FIG. 4B.

Figure 5:
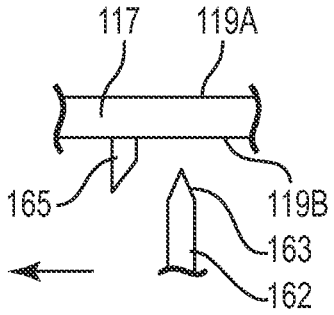
FIG. 5 is a partial side view schematically illustrating a scraper scraping a wiper of a shuttle, according to an embodiment of the present disclosure.

In one embodiment, after the wiper(s) 162 complete wiping of printheads 140, and as shown in FIG. 5, the travel of shuttle 160 in the second orientation (S) moves each wiper 162 into sliding contact relative to a scraper 165 on a bottom side 119B of carriage element 117 to remove ink waste from tip 163 of wiper 162.

Figure 6:
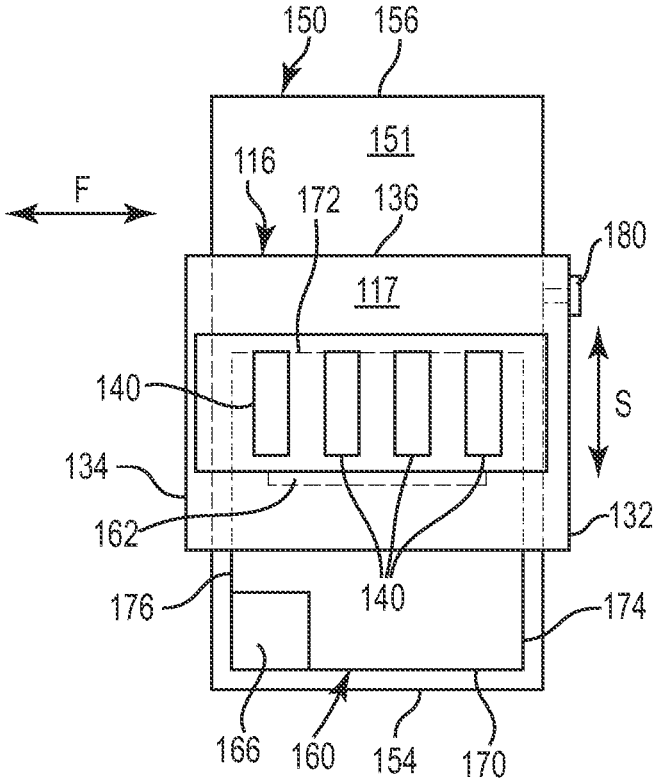
FIG. 6 is a top plan view schematically illustrating a printhead assembly in a third position relative to a service station and with a shuttle in a second position relative to a spittoon frame, according to an embodiment of the present disclosure.

As shown in FIG. 6, as part of the second servicing operation, shuttle 160 completes travel in the second orientation (S) to arrive in a second position where spittoon platform 166 is positioned adjacent first end portion 154 of spittoon frame 151. At this location, ink waste that was deposited on spittoon platform 166 is removed from spittoon platform 166 in a scraping action to be described more fully in association with FIGS. 7-12. Accordingly, while FIG. 6 shows a general location of spittoon platform 166 adjacent first end portion 154 of spittoon frame 151, spittoon platform 166 does not remain in a static position. Rather, the spittoon platform 166 (when first end 170 of shuttle 160 is adjacent first end portion 154 of spittoon frame 150) changes its position dynamically relative to first end portion 170 of shuttle 160, as will be described and illustrated in association with FIGS. 7-12.

Figure 7:
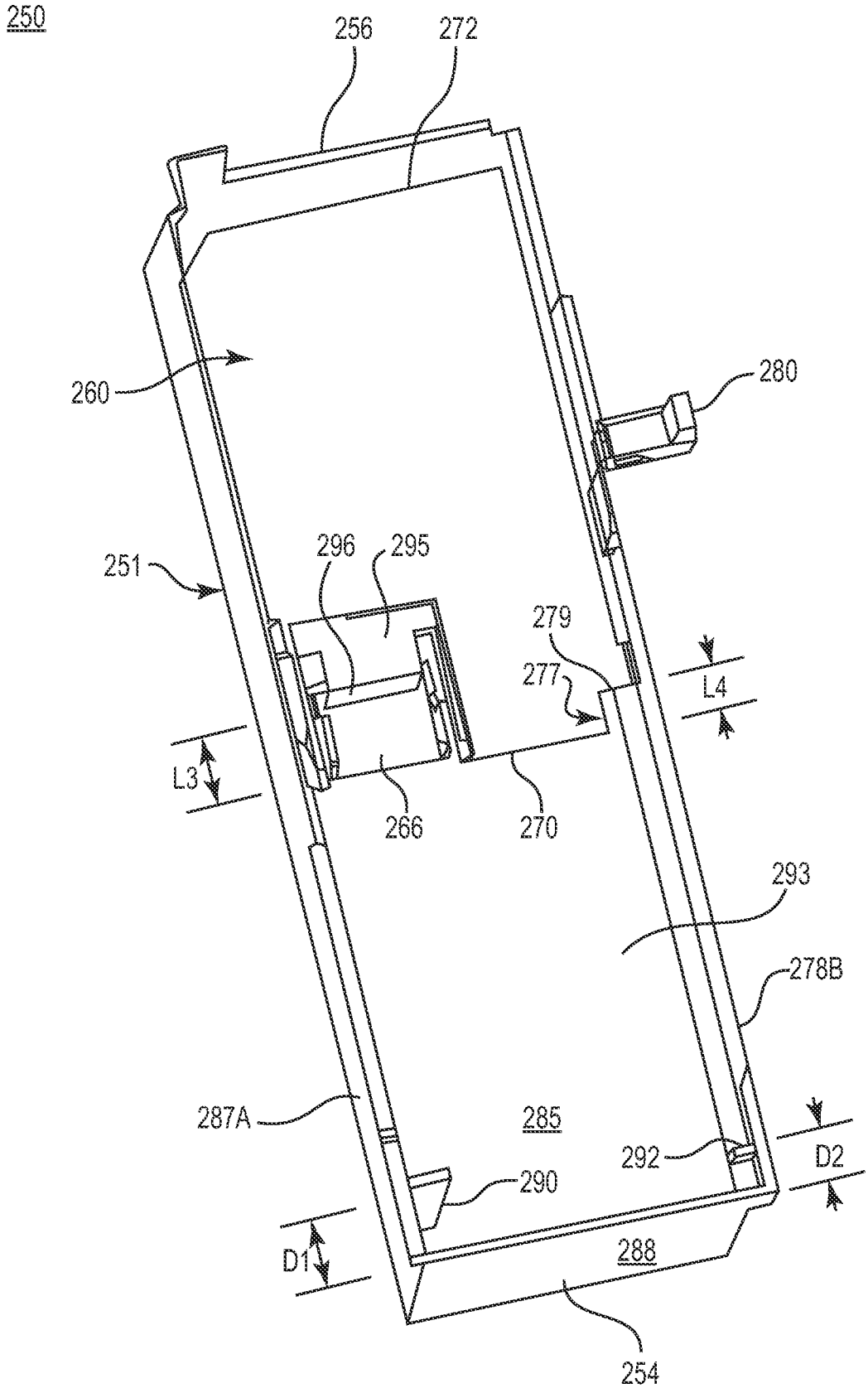
FIG. 7 is a top, left, and front perspective view schematically illustrating a service station including a shuttle in a first position relative to a spittoon frame and with a spittoon platform in a first extended position, according to an embodiment of the present disclosure.

FIG. 7 is a perspective view of a service station 250 of a printer, according to an embodiment of the present disclosure, with a shuttle 260 in a first position relative to a spittoon frame 251. In one embodiment, service station 250 includes at least substantially the same features and attributes as service station 150 (FIGS. 2-6) and service station 30 (FIG. 1), with like reference numerals referring to like elements. As shown in FIG. 7, shuttle 260 includes a first end portion 270 and second end portion 272 while spittoon frame 251 includes first end 254, second end 256, and stop element 280. In general terms, the position of shuttle 260 in FIG. 7 generally corresponds to the first position of shuttle 160 shown in FIG. 2.

In one aspect, spittoon frame 251 further includes a pair of side walls 287A, 287B spaced apart and opposite from each other, with spittoon frame 251 including an end wall 288 at first end 254. Moreover, also adjacent first end 254, spittoon frame 251 includes first protrusion 290 and second protrusion 292. The first protrusion 290 extends generally outward from, and generally perpendicular to, first side wall 287A while second protrusion 292 extends outward from, and generally perpendicular to, second side wall 287B. In each instance, the respective protrusions 290, 292 extend toward an interior 293 of spittoon frame 251. In one aspect, first protrusion 290 is spaced apart from end wall 288 by a distance (D1), which generally corresponds to at least a length (L3) of spittoon platform 266. In another aspect, second protrusion 292 is spaced apart from end wall 288 by a distance (D2), which generally corresponds to at least a length (L4) of a corner recess 277 at first end portion 270 of shuttle 260. In particular, edge 279 of recess 277 is spaced apart from first end portion 270 of shuttle 260 by the distance L4.

In one aspect, shuttle 260 also includes a stationary shelf 295 including a vertically downwardly projecting wall 296 which is positioned vertically above spittoon platform 266. The relationship of wall 296 and platform 266 are later described in more detail in association with FIGS. 8-12.

Figure 8:
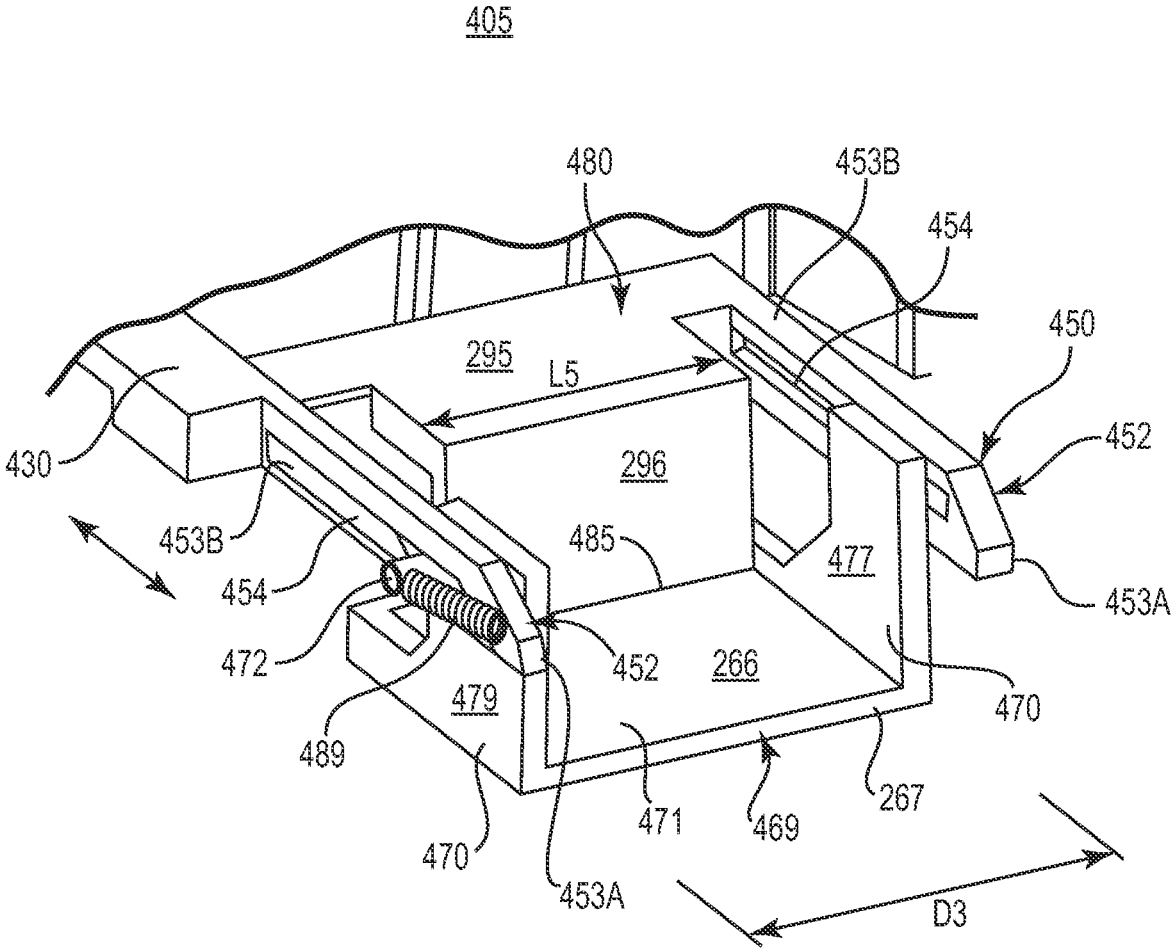
FIG. 8 is a top, left, and front perspective view schematically illustrating a spittoon platform in a first extended position relative to an end portion of a shuttle frame, according to an embodiment of the present disclosure.

FIG. 8 is an enlarged partial view schematically illustrating a spittoon platform assembly 405, according to an embodiment of the present disclosure, with spittoon platform 266 in an extended position. In general terms, spittoon platform assembly 405 is located at first end portion 170 of shuttle 160 (FIGS. 2 and 7). In one aspect, spittoon platform assembly 405 includes a biasing mechanism by which spittoon platform 266 is biased to remain in the extended position, until and unless a force overcomes the biasing force to move the platform 266 into a retracted position (as will be shown in FIG. 11). As previously illustrated in FIG. 7, in one embodiment the first protrusion 290 of spittoon frame 251 is a stationary element that provides the force (in view of the general movement of shuttle 260 into and against first protrusion 290) sufficient to temporarily overcome the biasing mechanism.

As shown in FIG. 8, spittoon platform assembly 405 includes the previously described movable spittoon platform 266 and stationary scraper wall 296. In addition, spittoon platform assembly 405 includes a pair of arms 452 that extend generally outward and away from scraper wall 296. Each arm 452 includes a base 453B extending from a general frame portion 430 of shuttle 260 and each arm 452 terminates in a distal end 453A. Moreover, each arm 452 defines an elongate slot 454 extending along a majority of a length of arm 452.

Spittoon platform assembly 405 includes a tray 469 with tray 469 including a target base portion 471 that defines spittoon platform 266 and with side walls 470 extending generally vertically upward from spittoon platform 266. Side walls 470 are opposite, and spaced apart from, to each other. In one aspect, side walls 470 are spaced apart by a distance (D3) which is slightly greater than a length (L5) of scraper wall 296, as shown in FIG. 8.

Each side wall 470 includes an inner surface 477 and an outer surface 479, with a pin 472 protruding outwardly from each outer surface 479. Each pin 472 is sized and shaped to extend generally perpendicular through the slot 454 of each arm 452, and to slidably move along a length of each slot 454. In this way, the arms 452 support slidable motion of tray 469 between its extended position (FIG. 8) and its retracted position (FIG. 11) via slidable movement of pins 472 through the slots 454.

In addition, in order to provide a biasing force to generally maintain tray 469 (and consequently platform 266) in the extended position, spittoon platform assembly 405 includes a spring 489 or other biasing element. In one aspect, spring 489 includes a first end mounted to end 453A of a respective one of the arms 452 and includes a second end mounted to the pin 472 or other portion of side wall 470. In this way, spring 489 tends to pull the tray 469 outward away from scraper wall 296 unless a force is applied to an end of the tray 469 in a direction opposite the pulling force of spring 469.

Figure 9:
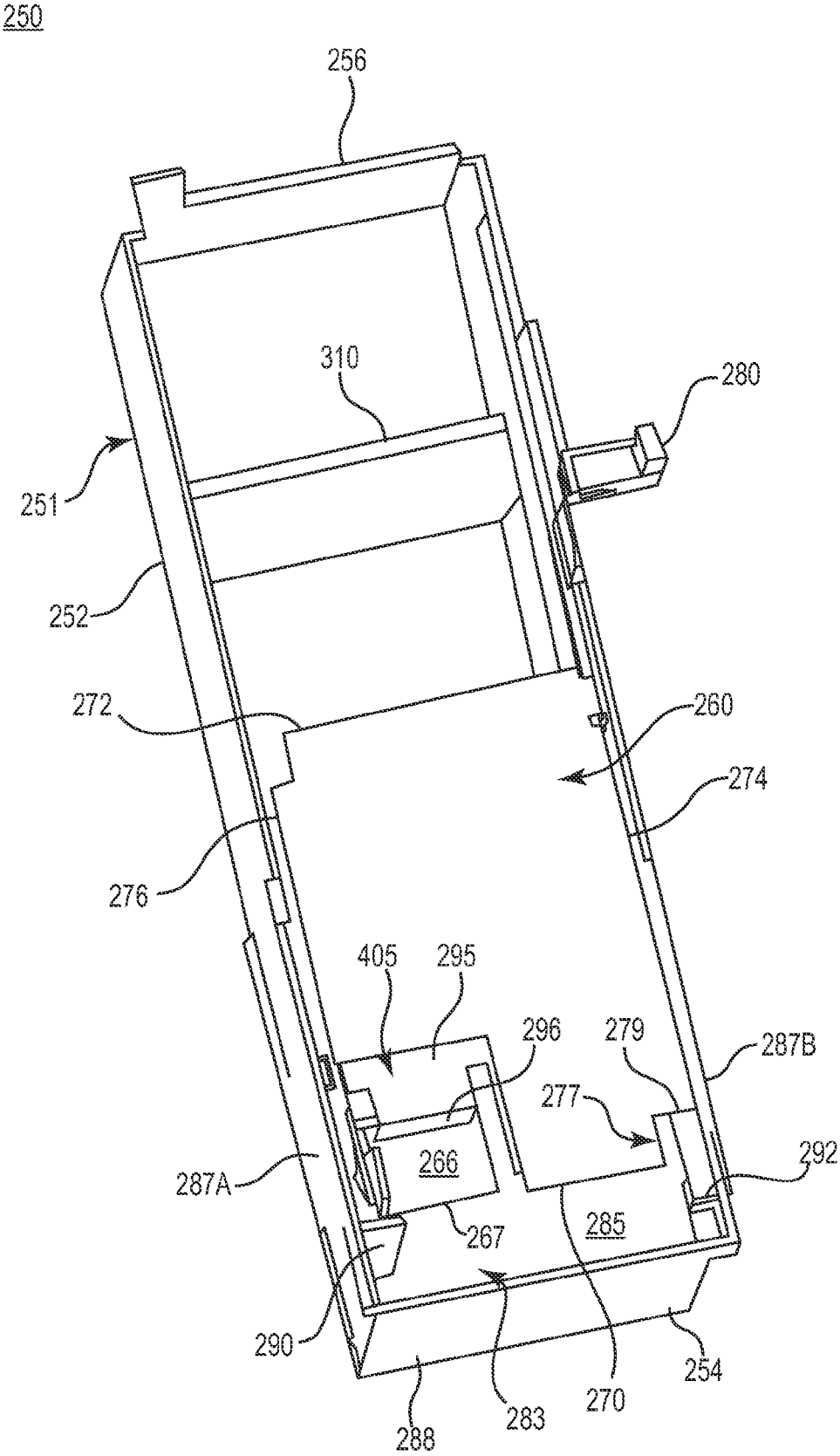
FIG. 9 is a top, left, and front perspective view schematically illustrating a service station including a shuttle in an intermediate second position relative to a spittoon frame and with a spittoon platform in a first extended position, according to an embodiment of the present disclosure.

In one embodiment, this opposing force is applied by first protrusion 290 of spittoon frame 251 (FIG. 7) when shuttle 260 is moved toward first end 254 of spittoon frame 251 causing end 267 of platform 266 (and of tray 469) to releasably contact first protrusion 290 as shuttle 260 continues to move toward first end 254 of spittoon frame 251, as shown in FIG. 9. However, it will be understood that in some embodiments, the opposing force could be applied by other elements associated with the spittoon frame 251.

FIG. 9 is a perspective view of the service station 250 previously described in association with FIGS. 7-8, according to an embodiment of the present disclosure, with shuttle 260 in a second intermediate position relative to the spittoon frame 251. In one aspect, as shown in FIG. 9, spittoon frame 251 includes a support member 310 extending transversely across a width (W1) of the spittoon frame 251.

FIG. 9 illustrates first end portion 270 of shuttle 260 approaching releasable contact relative to spittoon frame 251 as spittoon platform 266 is moved via controller 20 (FIG. 1) to a location remote, and spaced apart from, the spitting location (the location of platform 166, 266 shown in FIGS. 2 and 7, respectively). In particular, in this position of shuttle 260, end 267 of spittoon platform 266 makes releasable contact against first protrusion 290 (extending from side wall 287A) while edge 279 of corner recess 277 remains spaced apart from second protrusion 292 (extending from side wall 287B). However, in this position of shuttle 260, the spittoon platform 266 remains in its first extended position and any ink waste accumulated on spittoon platform 166 remains in place.

Figure 10:
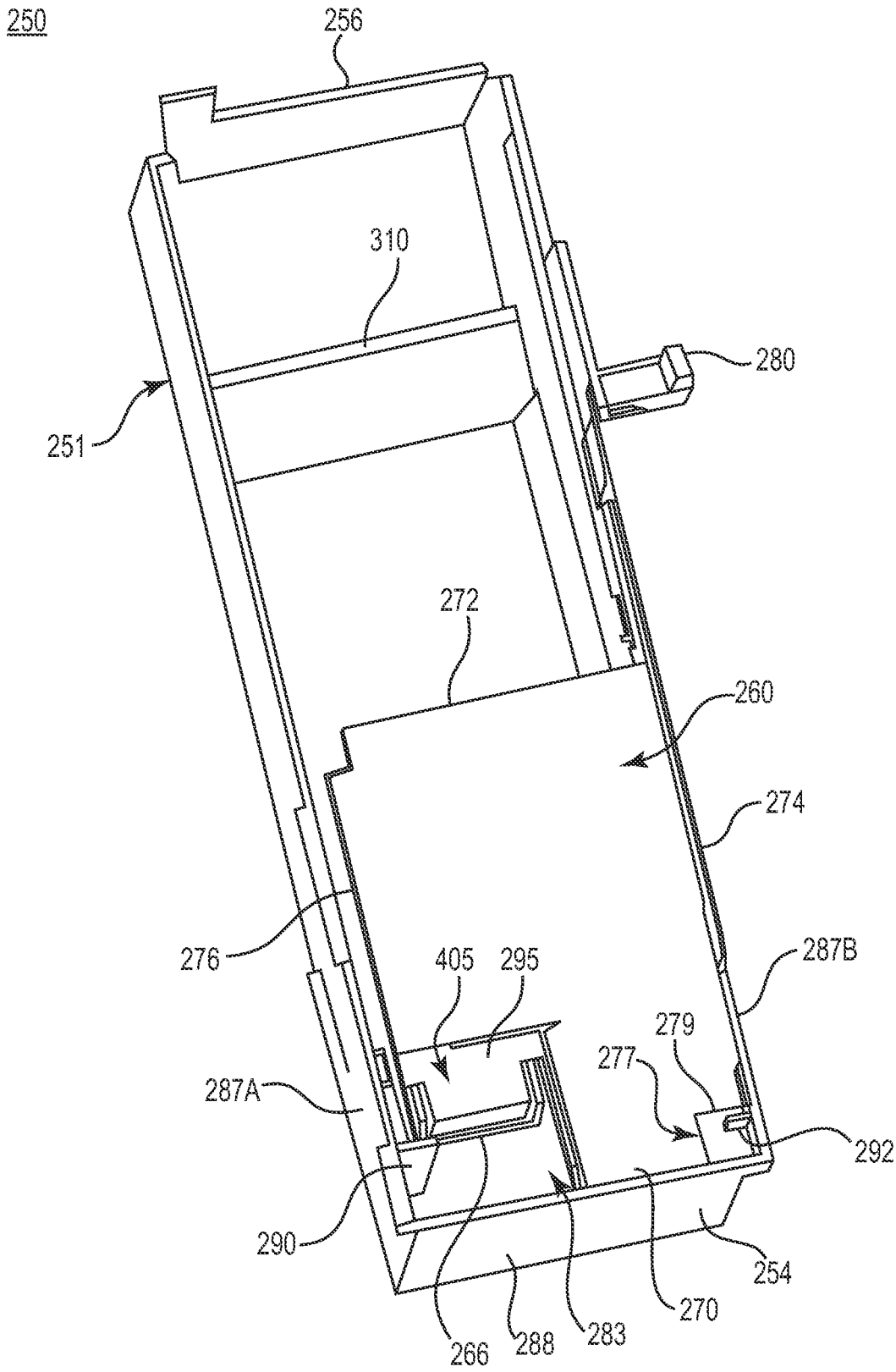
FIG. 10 is a top, left, and front perspective view schematically illustrating a service station including a shuttle in a third position relative to a spittoon frame and with a spittoon platform in a second retracted position, according to an embodiment of the present disclosure.

FIG. 10 is a perspective view of the service station 250 previously shown in FIGS. 7 and 9, according to an embodiment of the present disclosure, except with the first end portion 270 of shuttle 160 moved immediately adjacent to first end 254 of spittoon frame 251. As shuttle 260 moves into a finishing position shown in FIG. 10, edge 279 of corner recess 277 of shuttle 260 makes releasable contact with second protrusion 292 (on side wall 287B) of spittoon frame 251, thereby preventing further slidable movement of shuttle 260 toward first end portion 254 of spittoon frame 251.

Figure 11:
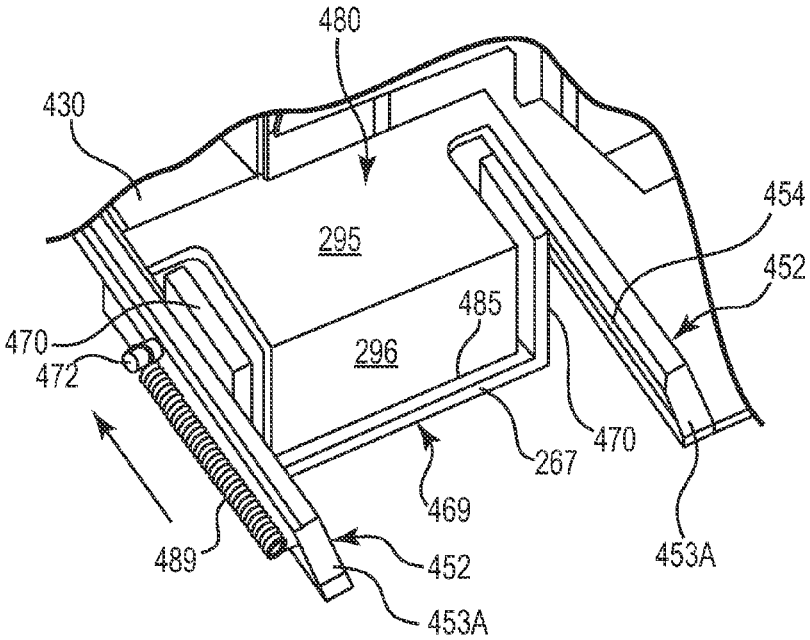
FIG. 11 is a top, left, and front perspective view schematically illustrating a spittoon platform in a second retracted position relative to an end portion of a shuttle frame, according to an embodiment of the present disclosure.

However, prior to shuttle 260 reaching the finishing position shown in FIG. 10, spittoon platform 266 becomes automatically activated to remove ink waste accumulated on spittoon platform 266 as further illustrated in FIG. 11. FIG. 11 is an enlarged partial view schematically illustrating spittoon platform assembly 405 of FIG. 8, according to an embodiment of the present disclosure, except with spittoon platform 266 in its fully retracted position. While it will be understood from FIGS. 7-10 that first protrusion 290 of spittoon frame 251 impedes slidable movement of spittoon platform 266 (adjacent first end portion 254) to cause its retraction, first protrusion 290 is not shown in FIG. 11 for illustrative purposes to better show the structure and operation of spittoon platform assembly 405.

As shown in FIG. 11, because of the releasable contact between end 267 of spittoon platform 266 and first protrusion 290 (FIGS. 7 and 10), the biasing force provided via spring 489 is overcome and the consequent stretching of spring 489 permits sliding movement of tray 469 (via pins 472 in slots 454 of arms 452) relative to scraper wall 296, until spittoon platform 266 is positioned underneath scraper wall 296. In one aspect, spittoon platform 266 and tray 469 remain in this position until controller 20 (FIG. 1) causes return of shuttle 260 to first position shown in FIG. 7.

Figure 12:
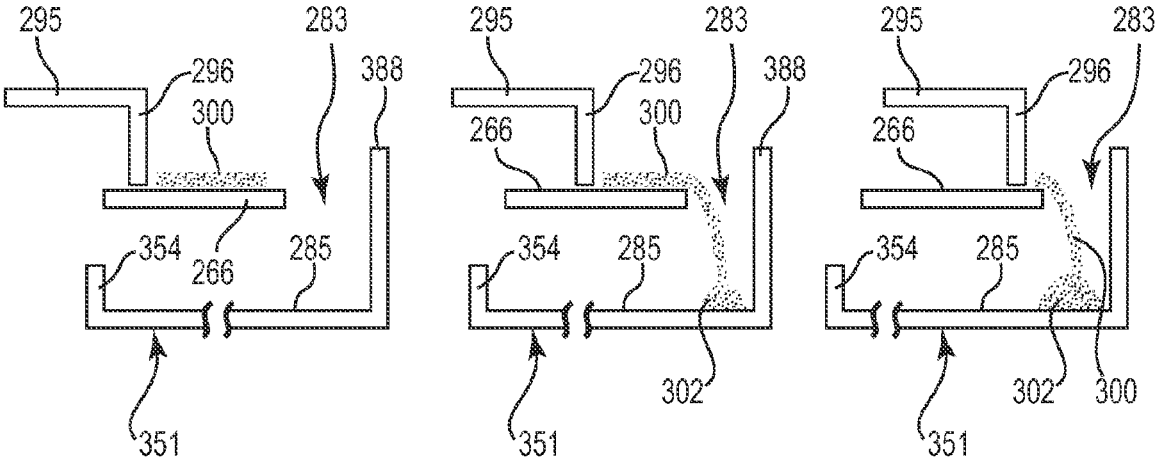
FIG. 12 is a diagram schematically illustrating the scraping of a spittoon platform, according to an embodiment of the present disclosure.

Nevertheless, FIGS. 10-11 illustrate the situation in which any ink waste 300 on spittoon platform 266 has been scraped off via scraper wall 296 and into reservoir portion 283, as described in more detail in FIG. 12.

FIG. 12 illustrates a scraping action of scraping wall 269 over spittoon platform 266 during the transition of spittoon platform 266 from its fully extended position (shown in FIGS. 7-9) and its fully retracted position (shown in FIGS. 10-11). As shown in frame (A) of FIG. 12, platform 266 is shown in its fully extended position relative to wall 296 with a volume of ink waste 300 that has accumulated on platform 266 from printhead servicing operations. Moreover, platform 266 is positioned vertically above a spittoon frame 351 having a first end wall 354 and a second end wall 388 with bottom portion 285 extending therebetween. In general terms, second end wall 388 generally corresponds to side wall 288 at first end 254 of spittoon frame 251 shown in at least FIGS. 7 and 9. Moreover, as shown in FIG. 12, spittoon frame 351 includes a reservoir portion 283 sized and shaped to receive ink waste with reservoir portion 283 being formed between walls 354, 356, and as shown in FIG. 10, between side walls 287A, 287B and end wall 288. Accordingly, the reservoir portion 283 is generally located adjacent first end portion 354 of spittoon frame 351.

As shown in frame B of FIG. 12, as spittoon platform 266 begins to be retracted relative to scraper wall 296, ink waste 300 is forced off spittoon platform 266 and, via force of gravity, falls into the reservoir portion 283 of spittoon frame 351 below the platform 266 where ink waste 300 accumulates. This frame B generally corresponds to the intermediate position in which platform 266 is between its fully extended position (shown in FIGS. 7-8) and its fully retracted position (shown in FIGS. 10-11).

As shown in Figure C of FIG. 12, spittoon platform 266 has become fully retracted relative to scraper wall 296 such that substantially all ink waste 300 has been scraped off spittoon platform 266 and into the reservoir portion 283 of spittoon frame 351 adjacent wall 388 (at first end portion 254 of spittoon frame 251 as shown in FIG. 10). In this way, ink waste 300 is transferred from the platform 266 (on which spitting occurs near midsection of spittoon frame 251 near printheads 140) to a first end portion 254 of the spittoon frame 351 remote from the printheads 140 at which the ink waste can further accumulate and be stored in a reservoir portion 283 of the spittoon frame 351. Accordingly, ink waste 300 is not allowed to build up in a region near the printheads 140 (when as a service station, such as service station 150 in FIGS. 3A, 4A) where it otherwise could be more likely to migrate into unwanted regions and otherwise potentially interfere with operation of the printer.

Embodiments of the present disclosure provide a spittoon platform that acts as a target for spitting operations and automatically transports the ink waste on the spittoon platform to a remote location at which the ink waste is scraped into a reservoir independent from the spittoon platform. In one embodiment, the ink waste is scraped off the spittoon platform generally simultaneous with other servicing operations, such as wiping a printhead or scraping a wiper. In this way, disposing of the ink waste occurs automatically. In one embodiment, the spittoon platform is mounted on a shuttle that moves relative to a spittoon frame with the spittoon frame including a reservoir portion, such that ink is spit from a printhead at a midportion of the spittoon frame onto the spittoon platform and then, upon movement of the shuttle toward an end portion of the spittoon frame, the ink waste is scraped off the spittoon platform into the reservoir portion.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this present disclosure be limited only by the claims and the equivalents thereof.

What is claimed is:

1. A printer service station comprising:

a frame including a reservoir portion and a stationary protrusion adjacent the reservoir portion; and a shuttle disposed vertically above the frame and slidably movable relative to the frame along a first orientation between a first shuttle position and a second shuttle position spaced apart, along a length of the frame, from the first shuttle position, wherein the shuttle comprises an end portion including a stationary element and a spittoon platform, the spittoon platform being slidably movable along the first orientation between a first platform position extending outwardly from the end portion and a second platform position retracted relative to the end portion, with the platform biased in the first platform position, wherein in the first shuttle position, the platform is spaced apart from the stationary protrusion and is in the first platform position and wherein upon movement of the shuttle into the second shuttle position, the platform releasably contacts the stationary protrusion to cause the platform to move from the first platform position into the second platform position to cause scraping movement of the platform relative to the stationary element of the shuttle.

2. The printer service station of claim 1, wherein the first shuttle position generally corresponds to a spitting location at an intermediate portion along the length of the frame and the second shuttle position generally corresponds to a scraping location above the reservoir portion at an end portion of the frame such that the scraping location is remotely spaced apart from the first shuttle position.

3. The station of claim 1, wherein the shuttle includes:

a wiper extending vertically upward from a top portion of the shuttle and positioned, when the shuttle slidably moves from the first shuttle position to the second shuttle position, to be slidably moved relative to a printhead to wipe a nozzle portion of the printhead.

4. The station of claim 1, wherein the stationary element of the shuttle includes at least one vertical wall portion disposed directly above at least a portion of the platform and in slidable contact with a top surface of the platform to cause scraping of the platform.

5. The station of claim 4, wherein the end portion of shuttle comprises a pair of arms extending generally outward from the vertical wall portion of the frame on opposite sides of the platform with each arm including a slot, and wherein the platform includes a peg on each opposite side of the platform to be slidably movable within and along the slot of each respective arm, and wherein at least one spring is connected between at least one of the respective arms and the platform to bias the platform in the first position.

6. The station of claim 1, wherein the frame includes:

a bottom portion;

a side wall extending vertically upward from the bottom portion, wherein the bottom portion and the side wall together at least partially define the reservoir portion of the frame, and wherein the protrusion extends generally perpendicular to the side wall and transversely to a path through which the platform moves relative to the frame.

7. The station of claim 1, wherein the spittoon platform is positioned underneath a path of slidable movement of a printhead in a second orientation generally perpendicular to the first orientation.

8. A printer comprising:

a service station comprising:

a frame including a reservoir portion and a stationary protrusion adjacent the reservoir portion; and a shuttle disposed vertically above and slidably movable relative to the frame in a first orientation between a first shuttle position and a second shuttle position spaced apart, along a length of the frame, from the first shuttle position, wherein the shuttle comprises an end portion and a spittoon platform, the spittoon platform being slidably movable between a first platform position extending outwardly from the end portion and a second platform position retracted relative to the end portion, with the platform biased in the first position, wherein in the first shuttle position, the platform is spaced apart from the stationary protrusion and is in the first platform position, and wherein upon movement of the shuttle into the second shuttle position, the platform releasably contacts the stationary protrusion to cause the platform to move from the first platform position into the second platform position to cause scraping movement of the platform relative to the end portion of the shuttle; and a printhead assembly selectably movable along a second orientation, generally perpendicular to the first orientation, to a service position over the service station at which the printhead assembly is positioned to perform spitting operations over the spittoon platform of the service station.

9. The printer of claim 8, wherein the shuttle includes:

a wiper extending vertically upward from a top portion of the shuttle and positioned, when the shuttle slidably moves relative to the spittoon frame, to be slidably moved relative to a printhead to wipe a nozzle portion of the printhead.

10. The printer of claim 8, wherein the end portion of the shuttle includes at least one vertical wall portion disposed directly above the platform and in slidable contact with a top surface of the platform to cause the scraping of the platform.

11. The printer of claim 8, wherein the frame includes:

a bottom portion;

at least one side wall extending vertically upward from the bottom portion, wherein the bottom portion and the at least one side wall together define at least the reservoir portion of the frame, and wherein the stationary protrusion extends generally perpendicular to the side wall and transversely to a path through which the platform moves relative to the frame.

12. The station of claim 1, wherein the slidable movement of the platform into the second platform position relative to the stationary element causes ink waste on the platform to move in a direction, along the first orientation, away from the first shuttle position.

13. The station of claim 1, wherein the first shuttle position corresponds to a spitting location and, when the shuttle is in a position other than the first shuttle position and the platform is in the first platform position, the stationary element of the shuttle is interposed between the first shuttle position and a spit-receiving surface of the spittoon platform.

14. The station of claim 3, wherein movement of the shuttle in a single direction along the first orientation results in both wiping of the printhead and scraping of the platform.

15. The station of claim 3, wherein the wiper and the platform are spaced apart by a distance such that the wiping of the printhead occurs generally simultaneously with scraping of the platform when the shuttle moves from the first shuttle position to the second shuttle position.

16. The station of claim 3, wherein the frame is in a stationary position at least during movement of the shuttle between the first and second shuttle positions and during movement of the platform between the first and second platform positions.

17. The station of claim 1, wherein the frame includes a first end portion and a second end portion, wherein the stationary protrusion is located at the first end portion within the reservoir portion and at the scraping location.

18. The station of claim 1, wherein an end portion of the platform releasably contacts the stationary protrusion when the shuttle is in the second shuttle position.

19. The station of claim 9, wherein movement of the shuttle in a single direction along the first orientation results in both wiping of the printhead and scraping of the platform, and wherein the wiper is positioned so that the wiping of the printhead occurs generally simultaneously with scraping of the platform when the platform is moved into the second platform position.

20. The printer of claim 9, comprising:

a carriage supporting the printhead assembly and having a bottom side including a scraper portion, wherein upon positioning of the printhead assembly into the service position, slidable movement of the shuttle relative to the carriage causes the scraper portion scraping movement between the wiper and the scraper portion.

21. A printer service station comprising:

a frame including a reservoir portion and a stationary protrusion adjacent the reservoir portion; and a shuttle disposed vertically above the frame and slidably movable relative to the frame along a first orientation between a first shuttle position and a second shuttle position spaced apart, along a length of the frame, from the first shuttle position, wherein the shuttle comprises an end portion including a stationary element and a spittoon platform, the spittoon platform being slidably movable along the first orientation between a first platform position extending outwardly from the end portion and a second platform position retracted relative to the end portion, with the platform biased in the first platform position, wherein in the first shuttle position, the platform is spaced apart from the stationary protrusion and is in the first platform position and wherein upon movement of the shuttle into the second shuttle position, an end portion of the platform releasably contacts the stationary protrusion to cause the platform to move from the first platform position into the second platform position to cause scraping movement of the platform relative to the stationary element of the shuttle, wherein the first shuttle position corresponds to a spitting location and when the platform is in the first platform position, the stationary element of the shuttle is interposed between the spitting location and a spit-receiving surface of the spittoon platform.

* * * * *